United States Patent [19]

Yaegashi et al.

[11] 4,155,332

[45] May 22, 1979

[54] ELECTRONIC FUEL INJECTION SYSTEM IN AN INTERNAL COMBUSTION ENGINE

[75] Inventors: Takehisa Yaegashi; Keiji Aoki; Takayoshi Nakatomi, all of Susono, Japan

[73] Assignee: Toyota Jidosha Kogyo Kabushiki Kaisha, Aichi, Japan

[21] Appl. No.: 834,552

[22] Filed: Sep. 19, 1977

[30] Foreign Application Priority Data

May 18, 1977 [JP] Japan ..... 52-56293

[51] Int. Cl.[2] ..... F02D 5/00

[52] U.S. Cl. ..... 123/32 EA; 123/32 EB

[58] Field of Search ..... 123/32 EA, 32 EB, 32 EH, 123/32 EL, 139 AW

[56] References Cited

U.S. PATENT DOCUMENTS

| | | | |
|---|---|---|---|
| 3,782,339 | 1/1974 | Scholl et al. | 123/32 EA |
| 3,898,962 | 8/1975 | Honig et al. | 123/32 EB |
| 3,906,207 | 9/1975 | Rivere et al. | 123/32 EB |
| 3,934,561 | 1/1976 | Romann et al. | 123/139 AW |
| 4,040,394 | 8/1977 | Wahl et al. | 123/32 EA |
| 4,048,965 | 9/1977 | Bianchi et al. | 123/32 EA |

*Primary Examiner*—Ronald H. Lazarus
*Assistant Examiner*—Andrew M. Dolinar
*Attorney, Agent, or Firm*—Stevens, Davis, Miller & Mosher

[57] ABSTRACT

This application discloses an electronic fuel injection system in an internal combustion engine. The system comprises: a fuel injector arranged on an intake pipe of the engine; a fuel control circuit for supplying fuel through said injector in response to the intake air quantity of the engine; an intake air flow meter electrically connected to said fuel control circuit; a pressure detector arranged in the intake manifold, said detector being electrically connected to said fuel control circuit; and an engine revolutional speed sensor electrically connected to said fuel control circuit; said fuel control circuit including: a comparing circuit which compares the intake air quantity with a predetermined value; a first control circuit which actuates said fuel injector in response to the output signals of said intake air flow meter and said engine revolutional speed sensor; and a second control circuit which actuates said fuel injector in response to the output signals of said pressure detector and said engine revolutional speed sensor, wherein said fuel control circuit comprises a selecting circuit which selects said first control circuit when the intake air quantity is below the predetermined value, and said second control circuit when the intake air quantity is above the predetermined value.

4 Claims, 9 Drawing Figures

Fig. 3
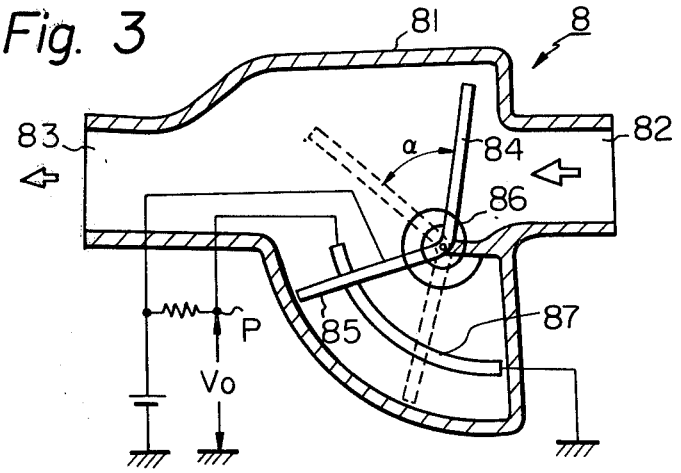
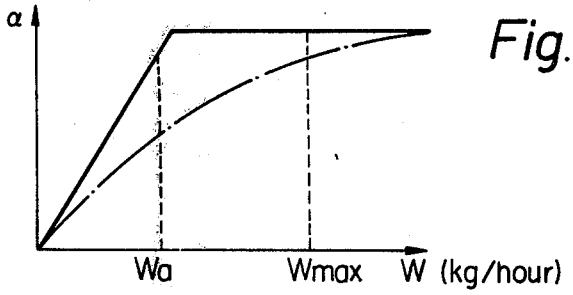
Fig. 4
Fig. 5
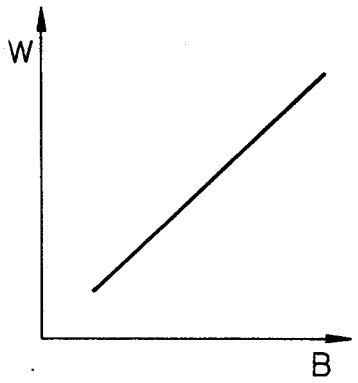

START
IS ENGINE AT START ?
YES
NO
READ THE INTAKE AIR QUANTITY DATUM W
READ THE ENGINE REVOLUTION COUNT DATUM N
IS INTAKE AIR QUANTITY W OVER Wa ?
YES
NO
READ THE PRESSURE IN THE INTAKE PIPE DATUM P
CALCULATE THE BASIC INJECTION QUANTITY ON THE BASIS OF P
CALCULATE THE INJECTION QUANTITY ON THE BASIS OF W/N

ELECTRONIC FUEL INJECTION SYSTEM IN AN INTERNAL COMBUSTION ENGINE

BACKGROUND OF THE INVENTION

The present invention relates to an electronic fuel injection system (EFI system) in an internal combustion engine.

In the EFI system, fuel is injected into the intake pipe of the engine through an injector, the injection timing being controlled so that it is synchronized with the engine revolution. Two types of EFI system are known. One is called a "speed density type" or "D-Jetronic type (D-J type)" EFI system. The other is called an "intake air flow sensing type" or "L-Jetronic type (L-J type)" EFI system.

In the D-J type EFI system, a fuel control circuit calculates the intake air quantity per engine revolution on the basis of the pressure in the intake manifold and the engine revolutional speed. Then, the circuit further calculates the optimum fuel injection quantity on the basis of the intake air quantity taking into account the engine conditions. The open time of the solenoid valve type injector is controlled by the circuit so that the calculated amount of fuel is supplied through the injector. If the engine revolutional speed is constant, the intake air quantity W is proportioned to the pressure B in the intake pipe, as shown in FIG. 5. The fuel control circuit has a memory circuit which memorizes the basic fuel injection quantity which corresponds to the intake air quantity which is proportional to the pressure in the intake manifold. The fuel control circuit determines the final fuel injection quantity by compensating the basic fuel injection quantity taking into account the engine revolutional speed. However, in the low revolutional speed range of the engine, the intake air quantity is greatly varied in response to the driving conditions of the engine or circumstances. Therefore, in the D-J type EFI system, the air-fuel ratio cannot be accurately controlled in the low revolutional speed range of the engine.

In the L-J type EFI system, the fuel control circuit calculates the optimum fuel injection quantity in response to the engine driving conditions on the basis of the output signals of an intake air flow meter and an engine speed sensor. The open time of the solenoid valve type injector is controlled by the circuit so that the calculated amount of fuel is supplied through the injector. Said intake air flow meter comprises: a dynamic pressure measuring plate rotatably arranged on the air flow passage in the intake pipe; and a spring which forces said plate against the air flow. The air flow quantity is detected by measuring the displacement of said plate caused by the dynamic pressure of the intake air of the engine. The intake air quantity greatly varies in response to the throttle valve opening, e.g., the quantity at full throttle opening is about twenty times that at idle operation of the engine. The air flow meter cannot accurately measure the intake air quantity throughout the entire range of the throttle valve opening because the quantity varies so much in response to the throttle valve opening as mentioned above. Besides, the output power of the engine is lost due to the increase of the intake air flow resistance because of the dynamic pressure measuring plate of the air flow meter, which is arranged against the intake air flow in the intake pipe.

SUMMARY OF THE INVENTION

It is an object of the invention to obviate the above mentioned drawbacks in the EFI system by combining the above mentioned two types of EFI systems. An EFI system according to the invention comprises:

a fuel injector arranged on an intake pipe of the engine;

a fuel control circuit for supplying fuel through said injector in response to the intake air quantity of the engine;

an intake air flow meter electrically connected to said fuel control circuit;

a pressure detector arranged in the intake manifold, said detector being electrically connected to said fuel control circuit; and an engine revolutional speed sensor electrically connected to said fuel control circuit; said fuel control circuit including:

a comparing circuit which compares the intake air quantity with a predetermined value;

a first control circuit which actuates said fuel injector in response to the output signals of said intake air flow meter and said engine revolutional speed sensor; and a second control circuit which actuates said fuel injector in response to the output signals of said pressure detector and said engine revolutional speed sensor, wherein said fuel control circuit comprises a selecting circuit which selects said first control circuit when the intake air quantity is below the predetermined value, and said second control circuit when the intake air quantity is above the predetermined value.

BRIEF DESCRIPTION OF THE DRAWINGS

The present invention will be further described with reference to the appended drawings, in which:

FIG. 3 is a diagrammatic sectional view of the air flow meter shown in FIG. 1;

FIG. 4 illustrates a displaced angle $\alpha$ of the dynamic pressure measuring plate of the air flow meter, a solid line showing the case of the present invention, while a dash-dot line shows the case of the prior art;

FIG. 5 illustrates an intake air quantity W with respect to the intake manifold pressure B;

DETAILED DESCRIPTION OF PREFERRED EMBODIMENTS

Figure 1:
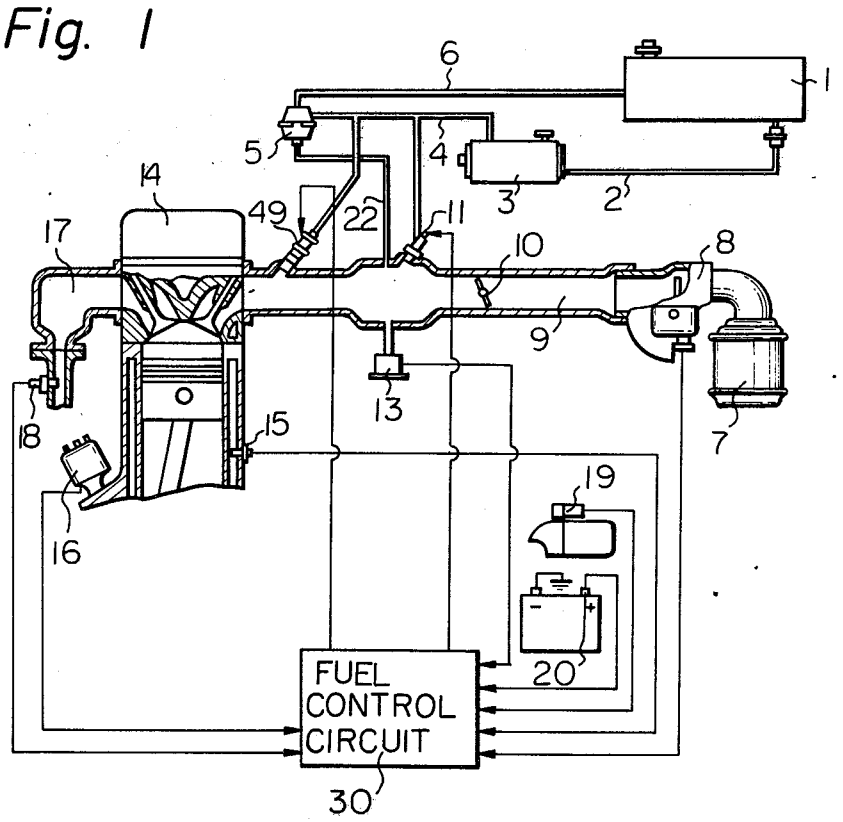
FIG. 1 is a diagrammatic view of an embodiment of the present invention.

An embodiment of the present invention will now be described with reference to FIG. 1. Fuel is supplied to a fuel valve 11 for starting the engine in low temperature or to a solenoid valve type fuel injector 49 from a fuel tank 1 by a fuel pump 3 through fuel pipes 2 and 4. A regulator 5 regulates the fuel pressure in response to the intake manifold pressure which acts upon the regulator 5 through a vacuum pipe 22. 6 indicates a fuel return pipe. Intake air is led to an engine 14 through an air cleaner 7 and an intake pipe 9. The intake air quantity is detected by an air flow meter 8 mounted on the intake pipe 9 at the upstream side of a throttle valve 10.

A pressure detector 13 is mounted on the intake manifold, i.e., on the intake pipe 9 at the downstream side of the throttle valve 10. An $O_2$ sensor 18 for detecting the oxygen density in the exhaust gas is mounted on an exhaust pipe 17. To the inputs of a fuel control circuit 30 are electrically connected the air flow meter 8, the pressure detector 13, an engine speed sensor 16 cooperating with a distributer, a thermo sensor 15 for sensing cooling water temperature, the $O_2$ sensor 18 and a solenoid terminal of a starting motor 19. 20 is a terminal of a battery.

Figure 2:
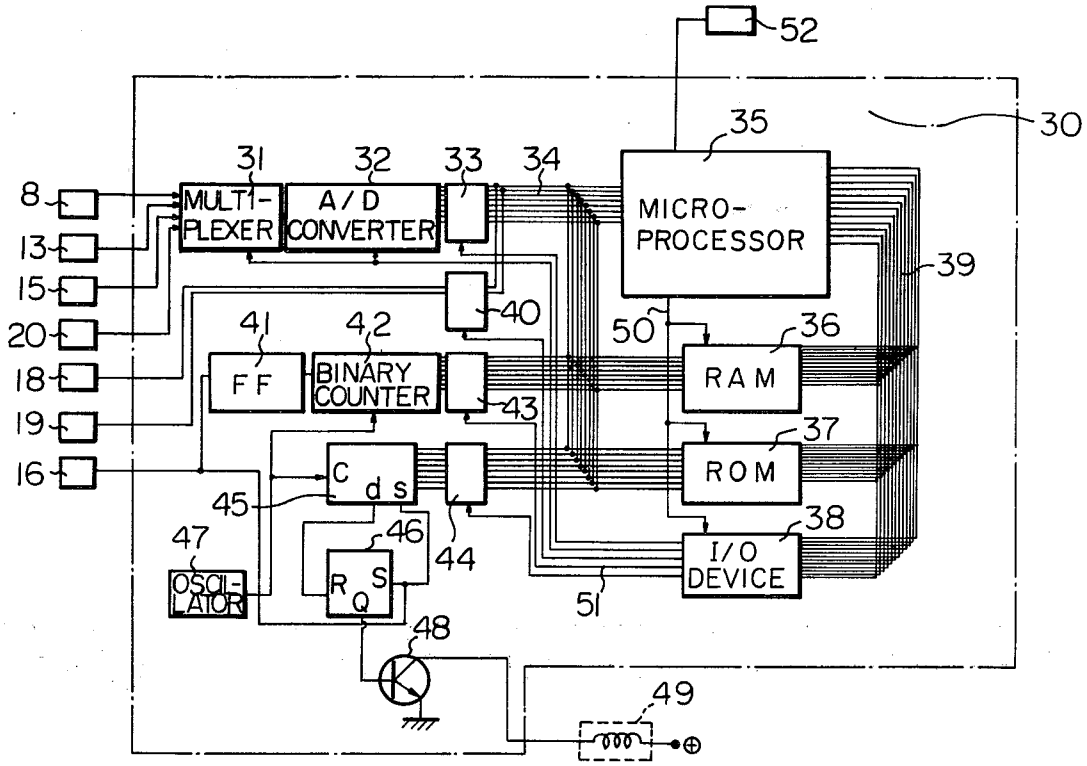
FIG. 2 illustrates a fuel control circuit according to the present invention.

FIG. 2 shows a digital type fuel control circuit 30. The air flow meter 8, the pressure detector 13, the thermo sensor 15 and the battery terminal 20 are connected to an analogue/digital convertor 32 via a multiplexer 31, and then to a microprocessor 35 via a gate circuit 33 through data lines 34. A RAM (random access memory) 36, a ROM (read only memory) 37 and a controller (I/O device) 38 are connected to the microprocessor 35 through a control line 50 and address lines 39. The $O_2$ sensor 18 and the starting motor 19 are connected to the microprocessor 35 via a gate circuit 40 through data lines 34. The engine speed sensor 16 is connected to the microprocessor 35 via a FF (Flip-flop) 41, a binary counter 42 and a gate circuit 43. The speed sensor 16 is also connected to a set-input terminal S of a set-reset FF 46 and to a set-input terminal S of a down-counter 45. A crystal oscillator 47 generates clock pulses which are transmitted to the binary counter 42 and to a clock-input terminal C of the down-counter 45 in order to achieve the digital (binary) control of the system. An output terminal d of the down-counter 45 is connected to a reset-input terminal R of the set-reset FF 46. An output terminal Q of the set-reset FF 46 is connected to an amplifier 48 which is in turn connected to a solenoid valve type injector 49. Binary input terminals of the down-counter 45 are connected to the microprocessor 35 via a latch circuit 44. The I/O device 38 actuates the multiplexer 31, the AD convertor 32, gate circuits 33, 40 and 43 and the latch circuit 44, via control lines 51, according to a predetermined control process operated by the microprocesser 35. A pulse generator 52 generates a pulse at a predetermined engine crank position. A program for controlling the operation of the microprocessor 35 which determined the fuel injection quantity is memorized in the ROM 37.

The air flow meter 8 will now be precisely described with reference to FIG. 3. Air flows from an inlet 82 to an outlet 83 as shown by arrows. A dynamic pressure measuring plate 84 is rotatably mounted on a body 81. A slide plate 85 of a variable resister 87 is integrally formed with the dynamic pressure measuring plate 84. A spiral spring 86 is arranged between the plate 84 and the body 81 in order to force the plate 84 against the air flow. The plate 84 is displaced by the force due to the dynamic pressure of the air flow. The displaced angle $\alpha$ of the plate 84 increases in proportion to the increase of the air flow rate. The output voltage $V_o$ is generated, in response to the displaced angle $\alpha$, at an output terminal P. The force of the spring 86 is relatively weak, compared with that of the prior art, so that the displaced angle $\alpha$ reaches maximum when the intake air quantity W is about (or slightly over) Wa (kg/hour), which is one half of the maximum intake air quantity Wmax of the engine (FIG. 4). Accordingly, the plate 84 is maintained fully opened when the intake air quantity W is over about Wa, i.e., one half of the maximum intake air quantity Wmax (kg/hour). Therefore, in the small intake air quantity range, the air flow meter 8 responds accurately to the intake air flow, and in the large intake air quantity range, the plate 84 of the air flow meter 8 does not impede the air flow because it is fully opened.

Figures 6, 6A, 6B:
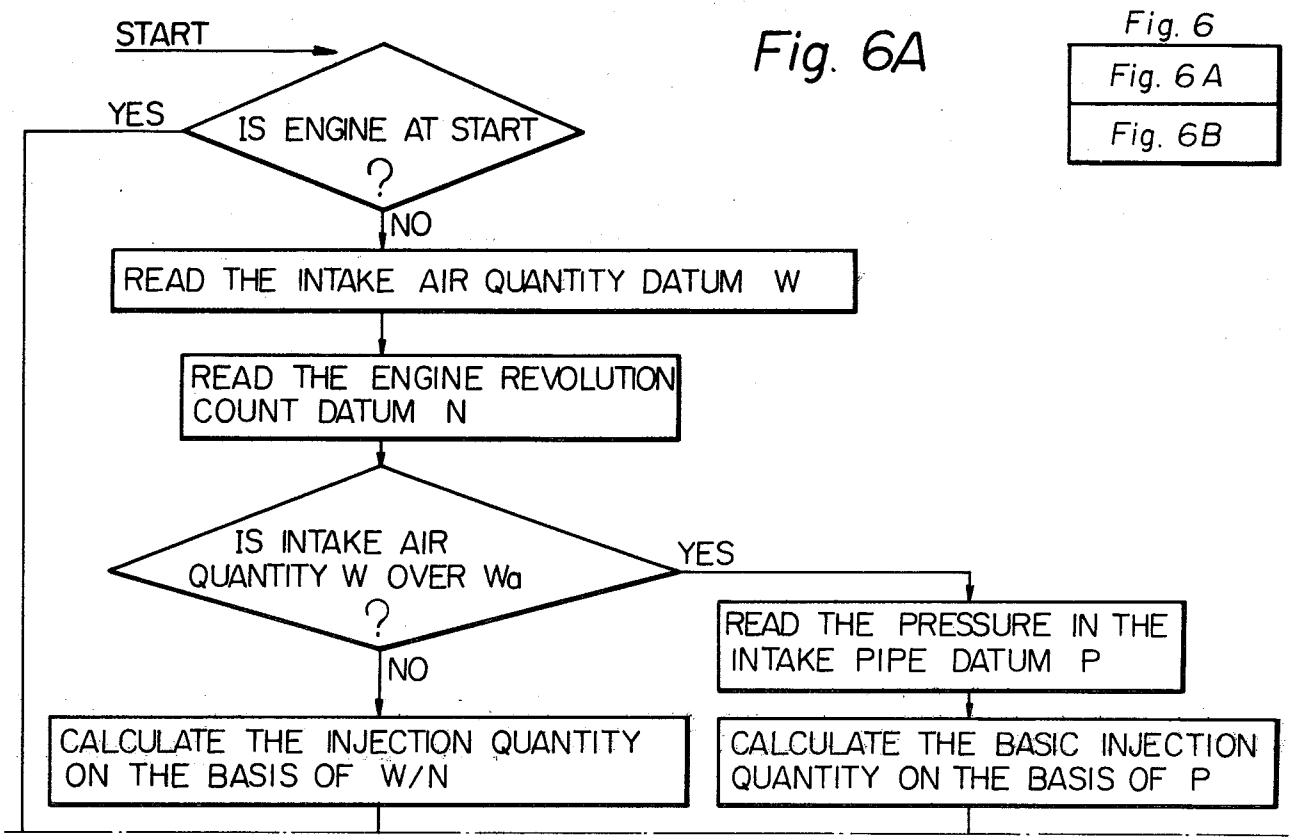
FIG. 6 is a flow sheet showing the calculating process in the fuel control circuit according to the invention.
Figure 6B:
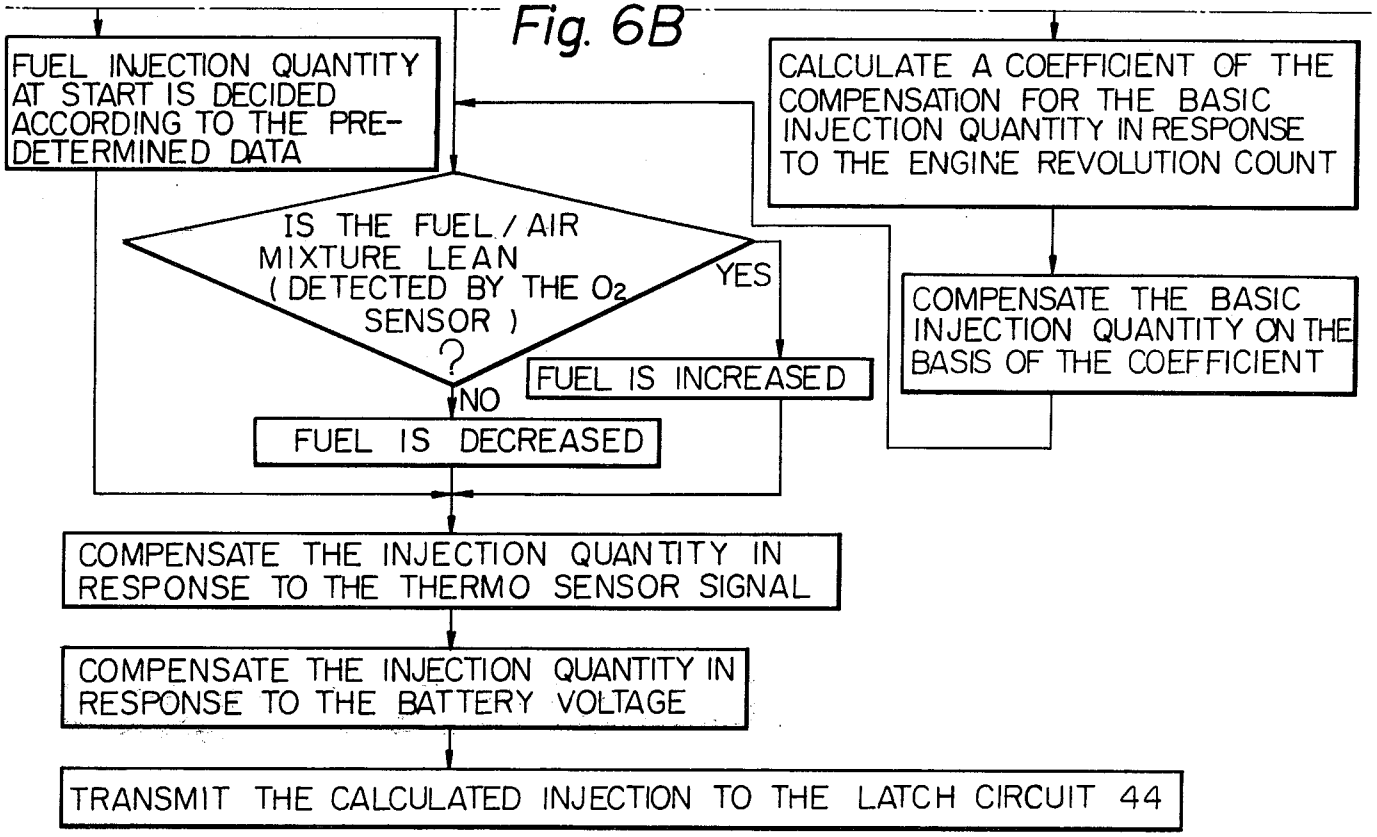

In operation, analogue signals from the air flow meter 8, the pressure detector 13, the thermo sensor 15 and the battery terminal 20 are converted to digital signals by the AD converter 32 according to the operation of the multiplexer 31. The digital signals are then transmitted to the microprocessor 35 and to the RAM 36 via the gate circuit 33. The signals from the $O_2$ sensor 18 and from the solenoid terminal of the starting motor 19, which signals are either "1" or "0", i.e., digital signals, are transmitted to the microprocessor 35 and to the RAM 36 via the gate circuit 40. The microprocessor 35 calculates the fuel injection quantity on the basis of the above digital signals. The engine speed sensor 16 generates a pulse signal the frequency of which is proportional to the engine revolutional speed. The pulse signal triggers the FF 41. The output pulse width of the FF 41 is in inverse proportion to the engine revolutional speed. The binary counter 42 counts the clock pulses from zero transmitted from the crystal oscillator 47 when the output pulse signal from the FF 41 is of a high level. When the output signal from the FF 41 changes from a high level to a low level, the output signal from the binary counter 42 is inversely proportioned to the engine revolutional speed. The output signal from the binary counter 42 is transmitted to the microprocessor 35 and to the RAM 36 via the gate circuit 43, and is used as one of the input signals for fuel injection quantity calculations. The microprocessor 35 calculates the fuel injection quantity according to the program memorized in the ROM 37 in advance. An example of the flow sheet of the program is shown in FIG. 6. A calculation start signal is transmitted to the microprocessor 35 from the pulse generator 52 (FIG. 2). At first, the microprocessor 35 judges whether the engine has just started or not by the signal from the starting motor 19. When the engine has just started, the fuel injection quantity is decided by compensating the predetermined basic fuel injection quantity in response to the signals from the thermo sensor 15 and battery terminal 20. When the engine is in normal operation, the microprocessor 35 reads data of intake air quantity W and engine revolution count N and judges whether the intake air quantity W is over Wa (kg/hour) FIG. 4) or not. If the intake air quantity W is below Wa (kg/hour), the fuel injection quantity is calculated by dividing W by N according to the L-J type EFI system. If the intake air quantity W is over Wa (kg/hour), the fuel injection quantity is calculated on the basis of the signal from the pressure detector 13 and, then, compensated in response to the engine revolutional speed according to the D-J type EFJ system. The calculated quantity is further compensated in response to the signal from the $O_2$ sensor 18 so that when the air/fuel ratio is lean, fuel is increased, and when the air/fuel ratio is rich, fuel is decreased. Such a compensation in response to the signal from the $O_2$ sensor 18 is advantageous, especially when a three-way catalyzer is mounted on the exhaust pipe of the engine. The above calculating program is memorized in ROM 37 in assembly language. The flow sheet is not limited to that shown in FIG. 6. The calculated injection quantity datum in binary digits is transmitted to the latch circuit 44 through data lines 34. The latch circuit 44 holds the datum according to the signal from the I/O device 38. Said datum held in the latch circuit 44 is then transmitted to the down-counter 45. The down-counter 45 is set by the input pulse signal from the engine speed sensor 16, reads said datum held in the latch circuit 44 and starts counting the clock pulses from the crystal oscillator 47. The set-reset FF 46 is also set by the signal from the engine speed sensor 16 at the same time the down-counter 45 starts counting. When the FF 46 is set, the signal from its output terminal Q changes to a high level, so that the amplifier 48 is actuated, so as to open the solenoid valve (not shown) of the injector 49. As a result, the fuel injection is started. When the down-counter 45 has counted the same number of the clock pulses as the calculated injection quantity datum, the count number of the down-counter 45 comes to zero and the signal from its output terminal d changes to a high level. The high level signal resets the set-reset FF 46 so that the signal from its output terminal Q changes to a low level, causing the amplifier 48 to be de-energized so as to stop the fuel injection by closing the solenoid valve of the injector 49. The injector 49 opens when the pulse signal from the engine speed sensor 16 has set the down-counter 45 and is kept opened until the down-counter 45 counts out the same number of clock pulses as the calculated injection quantity datum. Therefore, the opening time of the injector 49 is accurately proportional to the injection quantity datum calculated by the microprocessor 35. The microprocessor 35 repeats such a calculation at an interval of a predetermined rotation of the engine, e.g., at every one complete rotation of the engine, so that the opening time of the injector 49 is continuously controlled.

Figure 7:
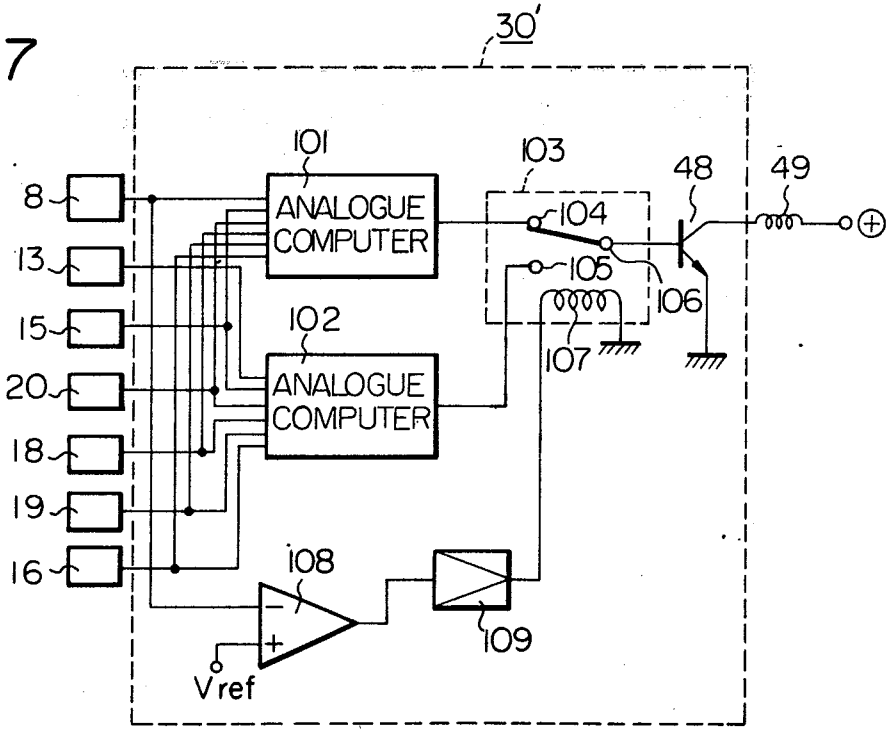
FIG. 7 illustrates another fuel control circuit according to the invention.

In FIG. 7, an analogue type fuel control circuit 30' is illustrated. The same reference numerals as used in FIGS. 1 and 2 indicate the same or corresponding parts to those illustrated in FIGS. 1 and 2. The circuit 30' comprises an analogue computer 101 for an L-J type EFI system, another analogue computer 102 for a D-J type EFI system, a comparator 108 and a relay 103. The relay 103 comprises a contact 104 connected to the computer 101, another contact 105 connected to the computer 102, a movable contact 106 and solenoid 107. The movable contact 106 is connected to a solenoid valve type fuel injector 49 via an amplifier 48. The output signal from the comparator 108 is amplified by an amplifier 109 and, then, actuates the solenoid 107 so as to change the contact points of the relay 103. An air flow meter 8 is connected to the computer 101 and to the comparator 108. A pressure detector 13 is connected only to the computer 102. A thermo sensor 15, an engine speed sensor 16, an $O_2$ sensor 18, a starting motor 19 and a battery terminal 20 are connected to the computer 101 and to the computer 102. The computer 101 calculates the fuel injection quantity in response to the output signals from the sensors and detectors according to the L-J type EFI system. The computer 102 also calculates the fuel injection quantity according to the D-J type EFI system. The constructions of the computers 101 and 102 are not described here because they are known. The air flow meter 8 is connected to one of the input terminals of the comparator 108. Reference signal Vref is supplied to the other input terminal of the comparator 108. The value of Vref is determined on the basis of the aforementioned intake air quantity Wa (kg/hour) (FIG. 4) which is one half of the maximum intake air quantity of the engine.

In operation, when the intake air quantity is below Wa (kg/hour), the output signal from the comparator 108 is of a low level and the movable contact 106 contacts the contact 104. As a result, the injector 49 is operated by the computer 101 which calculates the fuel injections quantity according to the L-J type EFI system. On the other hand, when the intake air quantity is above Wa (kg/hour), the output signal from the comparator 108 is of a high level and the solenoid 107 is energized via the amplifier 109. As a result, the movable contact 106 contacts the contact 105. Therefore, the injector 49 is operated by the computer 102, which calculates the fuel injection quantity according to the D-J type EFI system.

A semiconductor switch can be substituted for the relay 103.

As described hereinbefore, in the EFI system according to the invention, the fuel control circuit 30 or 30' determines whether the intake air quantity is over Wa (kg/hour) or below Wa (kg/hour) on the basis of the output signal from the air flow meter 8. If the intake air quantity is below Wa (kg/hour) the fuel injection quantity is calculated on the basis of the output signal from the air flow meter 8. If the intake air quantity is over Wa (kg/hour), the basic fuel injection quantity is calculated in the fuel control circuit on the basis of the signal from the pressure detector 13. Then the basic fuel injection quantity is compensated in response to the signal from the engine speed sensor 16.

The fuel control circuit can be operated in such a manner that it determines whether the air/fuel ratio is stoichiometric or not by the signal from the $O_2$ sensor 18. Then, in response to the determination, the fuel injection quantity is increased or decreased so that the air/fuel ratio nears the stoichiometric ratio.

In the EFI system according to the invention, when the intake air quantity is small, the fuel injection quantity is calculated according to the L-J type EFI system; and, when the intake air quantity is large, the fuel injection quantity is calculated according to the D-J type EFI system. Accordingly, in the EFI system according to the invention, the air/fuel ratio is accurately controlled over the entire range of intake air quantity. In addition, the reliability of the air flow meter is increased, because its measuring range is limited to the small intake air quantity. The lowering of the engine output power due to the resistance to the intake air flow is obviated because the spiral spring 86 of the air flow meter is weakened and the sectional area of the intake pipe is widened. Consequently, the air flow meter does not impede the air flow during the time a large intake air quantity is taken in because the meter is fully opened.

What is claimed is:

1. An electronic fuel injection system in an internal combustion engine having an intake pipe and a throttle valve therein, said system comprising:

a fuel injector arranged on the intake pipe of the engine;

a fuel control circuit for supplying fuel through said injector in response to the intake air quantity of the engine through the intake pipe;

an intake air flow meter in the intake pipe, said meter being electrically connected to said fuel control circuit;

a pressure detector arranged downstream of the throttle valve in the intake pipe, said detector being electrically connected to said fuel control circuit; and an engine revolutional speed sensor electrically connected to said fuel control circuit; said fuel control circuit including:

a comparing circuit which compares the intake air quantity with a predetermined value;

a first control circuit which actuates said fuel injector in response to the output signals of said intake air flow meter and said engine revolutional speed sensor; and a second control circuit which actuates said fuel injector in response to the output signals of said pressure detector and said engine revolutional speed sensor, wherein said fuel control circuit comprises a selecting circuit which selects said first control circuit when the intake air quantity through the intake pipe is below the predetermined value, and selects said second control circuit when the intake air quantity through the intake pipe is above the predetermined value.

2. An electronic fuel injection system according to claim 1, wherein said intake air flow meter comprises:

a dynamic pressure measuring plate rotatably arranged in the intake pipe; and a spring which biases said plate in a direction against the air flow, the air flow quantity being detected by the displacement of said plate caused by the dynamic pressure of the intake air of the engine, wherein the force of said spring applied to said plate against the air flow is relatively weak so that said plate is fully opened by the dynamic pressure of about one half of the maximum air flow quantity of the engine, whereby the resistance against the air flow is descreased.

3. An electronic fuel injection system according to claim 1, wherein the fuel control circuit comprises a digital computer.

4. An electronic fuel injection system according to claim 1, wherein the fuel control circuit comprises an analogue computer.

* * * * *